United States Patent [19]

Marchesi

[11] 4,259,916

[45] Apr. 7, 1981

[54] NEEDLE CONTROL DEVICE FOR SEWING MACHINES

[75] Inventor: Franco Marchesi, Pavia, Italy

[73] Assignee: Rockwell-Rimoldi S.p.A., Milan, Italy

[21] Appl. No.: 124,899

[22] Filed: Feb. 26, 1980

[30] Foreign Application Priority Data
Mar. 8, 1979 [IT] .....Italy 20823/79.

[51] Int. Cl.[3] ..... D05B 55/14
[52] U.S. Cl. ..... 112/221; 74/104
[58] Field of Search ..... 112/221, 270; 74/103, 74/104

[56] References Cited

U.S. PATENT DOCUMENTS

| | | | |
|---|---|---|---|
| 2,799,236 | 7/1957 | Marjorio et al. | 112/221 |
| 3,645,221 | 2/1972 | Hirayama | 112/221 |
| 3,731,643 | 5/1973 | Middlebrook | 112/221 |
| 4,037,548 | 7/1977 | Hirayama et al. | 112/221 |
| 4,167,913 | 9/1979 | Hirayama | 112/221 |

*Primary Examiner*—H. Hampton Hunter

[57] ABSTRACT

An improved device for operating a needle in a sewing machine having a needle supporting clamp that is guided for sliding movement in a vertical plane by a needle bar. The needle bar is pivotably mounted on and depends from a support member which causes it to automatically align itself and follow the effective path of travel of the needle supporting clamp. The support member is mounted on the machine frame and is eccentrically positionable which provides a means whereby it can be selectively located in a position whereat the needle bar depending therefrom will never be subjected to more than a minimum amount of resistance by the needle supporting clamp during the latter's sliding movement thereon.

8 Claims, 2 Drawing Figures

NEEDLE CONTROL DEVICE FOR SEWING MACHINES

BACKGROUND OF THE INVENTION

The present invention relates to a device for operating and controlling the needle in a sewing machine of the type having a needle supporting clamp which is mounted and guided for sliding movement on a stationary needle bar. The needle bar is mounted on the frame of the machine and pivotably connected to one end of a control lever that is pivotably supported intermediate its ends on a crank which forms the end of an oscillatably driven shaft of the machine. The opposite end of the control lever is pivotably connected to one end of a moveable lever element whose opposite end is also pivotably supported by the frame of the machine.

Devices of this type are well known in the art and are utilized because their particular design ensures low loading on the support bearing and on the pivot elements. This is attributed to the fact that the needle-supporting clamp has its fulcrum on that end of the control lever which is caused to move along a path which is substantially rectilinear and the needle bar is carried by the frame of the machine in a manner to effect a secondary function of serving as a means for movement of the needle about the fulcrum which interconnects said control lever with the needle-supporting clamp.

However, a number of disadvantages have been experienced with these known devices the disadvantages deriving from the fact that the needle bar is mounted on the frame in an operative position which is statically determined (i.e. the machine is not operating) and from the fact that the path through which the control lever passes is not a true rectilinear path. The path is, rather, similar to a double very elongated "S", the width of which is about 1 hundredth of a millimeter. These disadvantages or drawbacks are accentuated by the additional fact that each device has its own unique dimensions which differ from one another due to the tolerances which differentiate the individual components from each other and as a result, with each operating device mounted on a machine frame, it is necessary to separately determine the most desirable operating position of the needle bar relative to the path through which the needle-supporting clamp travels so as to reduce friction between the surfaces in sliding contact and consequently to reduce wear thereof.

The positioning of the needle bar with respect to the operating device is determined empirically by displacing and inclining said needle bar in its assembled seat until a position is found at which sliding of the needle-supporting clamp can be accomplished with a minimum of resistance.

Consequently, this manner of positioning depends very much on the skill of the person employed for the assembly of the machine, as a result of which even the wear of the two elements coupled together is influenced by a human factor.

It was further found that the needle-supporting clamp bears the major part of the negative effects of rubbing against the needle bar and that the most clear evidence of wear is found in particular at the extreme and opposing faces of the hole in said supporting clamp within which said needle bar is disposed.

This condition is due to the fact that a poorly positioned needle bar reacts to the stresses caused by the needle-supporting clamp particularly at points corresponding to the extreme points of its path since the double "S" has its greatest deviations at these extreme points.

A further negative factor encountered in known operating devices, and which favored wear of the needle clamp, is caused by the centrifugal force generated by the crank that is fixed to the oscillating shaft of the machine and pivotably connected at a central location on the control lever.

This crank, which as is known, is disposed in spaced relation to the needle bar and commences to generage a centrifugal force as soon as it starts to oscillate, and a large amount of force is transmitted to the movable lever element of the pivoting arrangement thus causing the needlesupporting clamp to place a greater load on the needle bar. Wear of the needle carrying clamp creates an increase in the amount of clearance or play between the hole provided in it for sliding movement on the needle bar and consequently leads to a gradual reduction of the loading forces thereon. However, this increase in clearance reduces the effectiveness of the specific function of the needle bar which is that of maintaining the operative phasing between the needle and the lower stitching instrumentalities of the sewing machine.

An object of the present invention is to eliminate the above described negative factors, the influences of which affect the efficiency of the complete operating device and of the needle-carrying clamp in particular.

SUMMARY OF THE INVENTION

The invention provides an operating device of the type described above in which it is no longer required that the needle bar be mounted on the frame under conditions which cannot be statically determined, and which is a condition that exacerbates the above described negative factors.

The device according to the invention provides a device for operating the needle of a sewing machine which includes a needle supporting clamp guided for sliding movement on a stationary needle bar carried by the frame of the machine. This supporting clamp is pivotably supported on one of the ends of a control lever which is pivotably attached at a point intermediate its ends to a crank that is fixed on one end of an oscillating shaft of the machine. The opposite end of the control lever is pivotably connected to a movable lever element that is also pivotably attached to the frame of the machine. The needle bar which serves as a guide member is attached to the frame by means of an adjustable support that is mounted in a fixed seat formed in the frame. This support includes a means for adjustment of the needle bar which is effective in varying the distance between said needle bar and the location for providing pivotal movement of the control lever and provides a means for establishing the most desirable operating position of the needle bar with respect to the elements with which it is operatively associated for actuating the needle.

The main advantage provided by this means of supporting the needle bar is that it eliminates the need to manually or empirically find the most desirable operating position for the needle bar with respect to the other elements of the operating device with which it must cooperate during the performance of its intended function. The adjustable support serves as an intermediary between the needle bar and the frame of the machine for quickly and easily obtaining the most desirable position for the needle bar, and the amount of displacement required can be determined by conventional measuring instruments.

A further characteristic which distinguishes the operating device of the present invention is that the needle bar is mounted for pivotal movement on the adjustable support which permits said needle bar to swing with respect to said adjustable support and to thus follow the needle-supporting clamp through its displacements while traveling which as is known, is not a true rectilinear path.

The main advantage derived from this characteristic is that it eliminates the time consuming problem of locating the needle bar in its most desirable operating position and allows said needle bar to automatically align itself with the pathway followed by the needle supporting clamp and to be subjected to a minimum of resistance by the latter. With the features described above, it is now possible to position the needle bar on the frame at a location that corresponds to the dimensions of the operating device and in particular at a distance which corresponds to the precise length of the control lever. Additionally, the needle bar can be inclined in accordance with the intermediate axis that contains the deviations of the double "S" shape of the pathway through which the needle-supporting clamp is caused to travel. These features also provide a consistent relationship between the needle-supporting clamp and needle bar from one operating phase to the next whereby said needle bar is never subjected to more than a minimum amount of sliding resistance.

A still further advantage provided by the present invention is that the distance the needle supporting clamp travels in an upwardly direction can now be increased which makes it possible to perform seaming operations on workpieces of greater thicknesses. This is made possible due to the fact that the needle bar is now capable of pivoting movement which permits it to align itself automatically with the needle supporting clamp and is no longer subjected to bending forces which it was caused to resist with known devices utilizing the double "S" shape of pathway.

Other objects and advantages of the invention will become more fully apparent by reference to the appended claims and as the following detailed description proceeds in reference to the figures of drawing wherein:

DESCRIPTION OF THE PREFERRED EMBODIMENT

Figure 1:
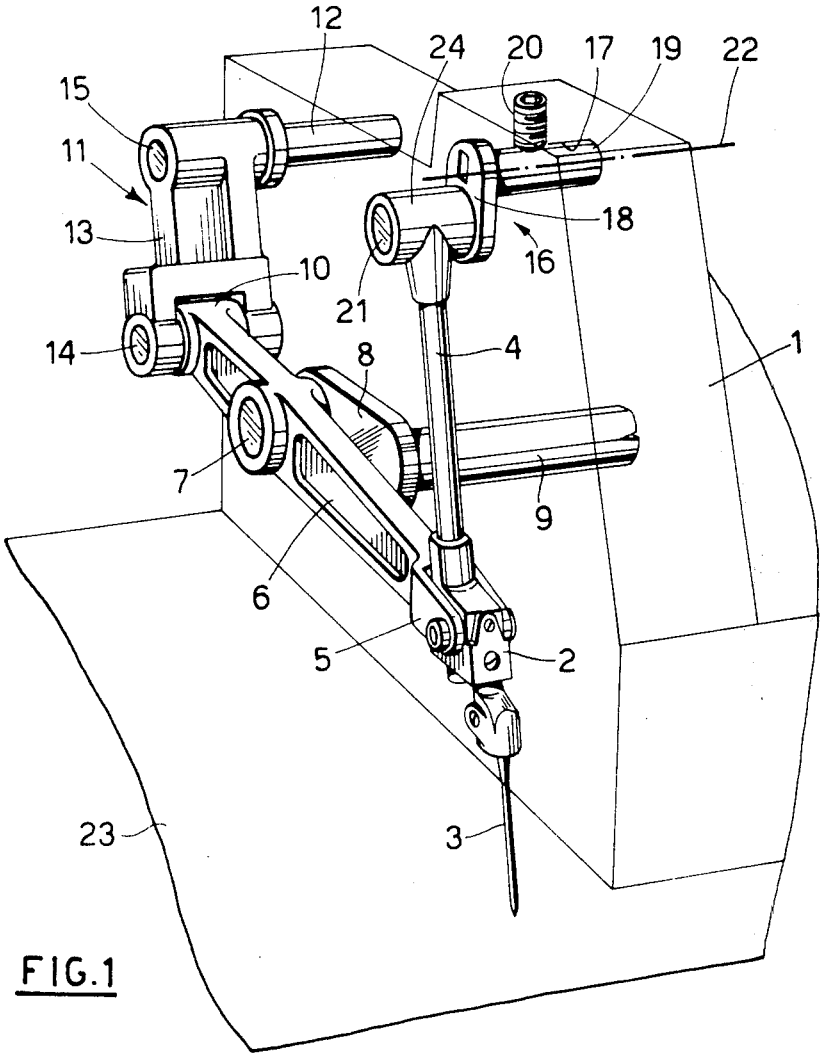
FIG. 1 is a perspective view of a portion of a sewing machine showing the device according to the invention applied thereto.

With reference to FIG. 1, the device for operating the needle according to the present invention is mounted on the frame 1 of the sewing machine, which for purpose of simplicity has been shown only in outline form. The operating device includes among its various parts, a needle-supporting clamp 2 with a needle 3 mounted therein and with said clamp 2 being disposed for sliding movement on a needle bar 4. This needle bar 4 is of the stationary type and is mounted on the frame of the machine in a manner that will be more fully described hereinafter.

The needle-carrying clamp 2 is pivotably mounted on one end 5 of a control lever 6 which is also pivotably mounted at a point intermediate its ends on a pivot pin 7. This pivot pin 7 is operatively connected to a crank 8 which is fixedly assembled on one end of an oscillatably driven shaft 9 of the sewing machine.

The end of the control lever 6 opposite end 5 is identified by numeral 10 and is pivotably connected to a movable lever element generally indicated by numeral 11 that is mounted for swinging movement on a pivot pin 12 which is supported by the frame of the machine.

This movable lever element 11 actually defines a forked lever 13 and operatively connects the end 10 of the control lever 6 in the forked portion thereof by means of a pin 14. This forked lever 13 provides a means whereby the end 10 of the control lever 6 can be displaced substantially rectilinear in a direction that is perpendicular to the needle bar 4 and simultaneously allows said control lever 6 to swing with the crank 8.

As is well known to those conversant in the art this manner of effecting movement of the end 10 of the control lever 6 is required in order that the opposite end 5 of the latter will travel in a pathway which is substantially rectilinear and parallel to needle bar 4.

The oscillatably driven shaft 9 moves the crank 8 so that it defines an arc of a circle about the shaft and the control lever 6 being connected to said crank by means of pivot pin 7 is caused to pivot on pin 14 and effect alternate upwardly and downwardly travel of the end 5 thereof.

Simultaneously with its pivoting movement on pin 14, the control lever is caused to be displaced short distances both in a forwardly and rearwardly direction with respect to the needle bar 4 which permits it to follow the curve of the arc of the circle defined by the crank 8.

The combination of the two movements of the control lever 6 described above effects movement of the needle-supporting clamp 2 in a like manner which is mounted on the end 5 of said control lever.

To prevent any possible interference or other negative factor with the desired movement of a needle supporting clamp 2, it is necessary that the needle bars 4 be separately and independently positioned in order to obtain their most desirable operating position on each device applied to a sewing machine. A needle bar cannot be mounted on the frame of a sewing machine in a predetermined position because the various elements with which it cooperates to perform its intended function have dimensions which vary and which is attributed to differences in manufacturing tolerances. Additionally differences in manufacturing tolerances are also present between the locations of the seats in the frame that are adapted to support the pivot pin 12, the oscillatably driven shaft 9 and the needle bar 4 and further contribute to the necessity for independent positioning of the needle bars. To obtain the desired operating position of the needle bar 4, the invention provides a means whereby it is mounted on an adjustable support 16 that is assembled in and extends from a fixed seat 17 formed in frame 1. The adjustable support 16 includes a body portion 18 having a regulating means that defines a support pin 19 that provides a fulcrum for said adjustable support and is adapted to assemble in the fixed seat 17 wherein it can be selectively positioned and maintained in a desired position by a locking member defining a set screw 20.

A pin member 21 is attached to the body portion 18 so as to extend outwardly from the frame and provide a means for pivotable supporting the needle bar 4. The axis of this pin member 21 is disposed in spaced relation to a common axis 22 of the fixed seat 17 and support pin 19 but extends in a direction that is parallel therewith. This common axis 22 is oriented perpendicularly to a vertical plane which extends to the machine's worksurface 23. This vertical plane contains the control lever 6 at a location intermediate the worksurface 23 and the common axis 22 which is disposed in spaced relation to said worksurface but extends parallel therewith. The needle bar 4 depends from a head 24 of "T" shaped configuration which is adapted to be pivotably supported on the pin member 21 and is eccentrically positionable by means of the adjustable support 16.

The head 24 is attached to the needle bar in a manner whereby the longitudinal extent of the latter extends parallel to the aforementioned vertical plane which contains the control lever 6.

With the needle bar supported in this manner it is capable of independent pivoting relative to the adjustable support 16 so that when the latter is selectively rotated about the common axis 22, the preferred location of the needle bar is arrived at by locating the pin member 21 at its most favorable operating distance from the pivot pin 7. In other words, the adjustable support 16 provides a means for obtaining the most effective position of the needle bar 4 relative to the distance which separates it from the pivot pin 7 of the control lever 6. The head 24 being pivotably supported on pin member 21 permits the needle bar 4 to follow the deviations which the needle supporting clamp 2 is caused to make during its sliding movement thereon so that said needle bar is never subjected to more than a minimum amount of resistance from said needle supporting clamp.

Axial displacements of the adjustable support 16 with respect to the fixed seat 17 in the frame 1 provide a means which make it possible to eliminate any negative condition that could possible exist between the needle bar and the needle-carrying clamp which, for example, could be caused by inadequate reciprocal positioning between the control lever 6 and the crank 8 which is fixed to the oscillating driven shaft 9 of the machine. The adjustable support 16 has been shown as formed by two separate elements comprising a body porton 18 and a support pin and pin member 19 and 21 respectively. The combination of these elements, as has been heretofor described, serves to position the support 16 in an adjustable manner on the frame and to provide a fulcrum for the needle bar.

Figure 2:
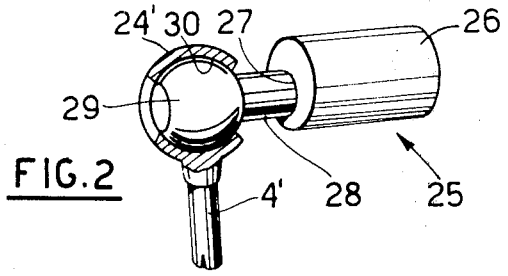
FIG. 2 is a perspective view showing a modification of the adjustable support for the needle bar.

Referring now to FIG. 2, the modification of the adjustable support is identified generally by numeral 25 and includes a support bushing 26 which defines a fulcrum for said adjustable support. This support bushing is adapted to be assembled in the fixed seat 17 provided in the frame 1 and is provided with an off-center hole 27 extending therethrough the axis of which is spaced from but extends parallel with the axis of said support bushing. A pin 28 assembles within the hole 27 and extending therefrom its outer portion can be selectively positioned eccentrically in the same manner as pin member 21 of the adjustable support 16. In FIG. 2 the needle bar is identified by numeral 4' which depends from a head 24' having an outer configuration that is generally spherical. The outer end of the pin 28 has a spherical member 29 fixed thereon and is adapted to assemble within the head 24' which has a configuration, identified by numeral 30, that conforms to the outer surface of said spherical member 29 and the combination define a ball and socket arrangement for pivotably supporting the needle bar 4'. It should be understood that the combination of the bushing 26 and pin 28 could also be utilized to pivotably support and selectively position the head 24 of "T" shaped configuration of the adjustable support 16 and would function in the same manner as provided for by the supporting elements for said head 24. As with the elements of the adjustable support 16, the ball and socket arrangement of the adjustable support 25 permits the needle bar 4' to follow the deviations which the needle supporting clamp 2 is caused to make during its sliding movement thereon. In other words, the needle bar 4' is capable of automatic alignment with the pathway of the supporting clamp 2 should the latter be caused to function in a plane that is not truly orthogonal to the plane containing the common axis 22.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for operating a needle in a sewing machine having a needle-supporting clamp mounted for sliding and guided movement in a vertical plane on a needle bar supported by the machine's frame and pivotably attached to a control lever that is pivoted at one end of a movable lever element and intermediate its ends to a crank fixed on an oscillatably driven shaft of the machine, the improvement comprising:

(a) a fixed seat provided in the frame of the sewing machine;

(b) a support member assembled in and extending from said fixed seat having an axis extending perpendicular to the vertical plane of movement of the needle-supporting clamp;

(c) means operatively connected to said support member having an axis spaced from and extending parallel with the axis of said support member for supporting the needle bar;

(d) means attached to the upper end of the needle bar for pivoting the latter on said supporting means to effect automatic alignment thereof with the effective path of travel of the needle supporting clamp; and (e) means operatively with said support member for effecting selective eccentric positioning of said supporting means to selectively vary the distance between the needle bar and the point of attachment of the control lever to the crank on the oscillatably driven shaft.

2. The apparatus according to claim 1 wherein said support member defines a support pin (19) having a body portion (18) fixed on one end thereof.

3. The apparatus according to claim 2 wherein said supporting means defines a pin member (21) fixed on and extending from that side of said body portion (18) opposite to which said support pin 19 is fixed.

4. The apparatus according to claim 3 wherein said pivoting means defines a head 24 of "T" shaped configuration pivotably mounted on said pin member (21).

5. The apparatus according to claim 1 wherein said support member defines a support bushing (26) with a pin (28) mounted therein and extending therefrom with its axis being spaced from and extending parallel with the axis of said support bushing (26).

6. The apparatus according to claim 5 wherein said supporting means defines a spherical member (29) fixed on the outer end of said pin (28).

7. The apparatus according to claim 6 wherein said pivoting means defines a head (24') having an internal surface (30) conforming to and operatively connected to said spherical member (29).

8. The apparatus according to claim 1 wherein said eccentric positioning means defines a locking member (20) mounted in the frame of the machine in operative association with said fixed seat.

* * * * *